US008062192B1

(12) United States Patent
Arstein

(10) Patent No.: US 8,062,192 B1
(45) Date of Patent: Nov. 22, 2011

(54) PORTABLE STATIONARY BICYCLE TRAINER

(76) Inventor: Shawn Arstein, San Antonio, TX (US)

( * ) Notice: Subject to any disclaimer, the term of this patent is extended or adjusted under 35 U.S.C. 154(b) by 78 days.

(21) Appl. No.: 12/780,286

(22) Filed: May 14, 2010

(51) Int. Cl.
*A63B 21/00* (2006.01)
*B62K 13/00* (2006.01)

(52) U.S. Cl. ..... 482/57; 280/7.1

(58) Field of Classification Search ..... 482/51–55, 482/57–65; 280/1, 21.1, 15–17
See application file for complete search history.

(56) References Cited

U.S. PATENT DOCUMENTS

| | | | | | |
|---|---|---|---|---|---|
| 2,680,020 | A * | 6/1954 | Dwyer | 472/99 |
| 4,492,374 | A * | 1/1985 | Lekhtman et al. | 482/77 |
| 4,696,467 | A * | 9/1987 | Markow | 482/77 |
| 4,743,012 | A * | 5/1988 | Kim | 482/61 |
| 4,902,004 | A * | 2/1990 | Gerlach | 482/77 |
| 4,915,376 | A * | 4/1990 | St. Clair | 482/57 |
| RE34,478 | E * | 12/1993 | Dalebout et al. | 482/59 |
| 5,292,295 | A * | 3/1994 | Gerlach | 482/77 |
| 5,423,728 | A * | 6/1995 | Goldberg | 482/57 |
| 5,512,025 | A * | 4/1996 | Dalebout et al. | 482/6 |
| 5,549,527 | A * | 8/1996 | Yu | 482/57 |
| 5,582,567 | A * | 12/1996 | Chang | 482/146 |
| 5,897,474 | A * | 4/1999 | Romero | 482/146 |
| 6,126,577 | A * | 10/2000 | Chang | 482/57 |
| 6,132,341 | A * | 10/2000 | Lin | 482/57 |
| 6,322,480 | B1 * | 11/2001 | Lim et al. | 482/57 |
| 6,475,122 | B2 * | 11/2002 | Wu | 482/57 |
| 6,488,611 | B1 * | 12/2002 | Ambrosina et al. | 482/63 |
| 6,527,681 | B2 * | 3/2003 | Tacx | 482/61 |
| 6,551,220 | B1 * | 4/2003 | Schroeder | 482/57 |
| 6,554,753 | B1 * | 4/2003 | Weck et al. | 482/147 |
| 6,561,955 | B1 * | 5/2003 | Dreissigacker et al. | 482/57 |
| 6,569,063 | B2 * | 5/2003 | Chen | 482/63 |
| 6,648,802 | B2 * | 11/2003 | Ware | 482/57 |
| 6,702,721 | B2 * | 3/2004 | Schroeder | 482/61 |
| 6,705,977 | B1 * | 3/2004 | Ziak | 482/146 |
| 6,749,543 | B2 * | 6/2004 | McLaughlin | 482/57 |
| 6,793,608 | B2 * | 9/2004 | Goldberg et al. | 482/57 |
| 6,793,609 | B1 * | 9/2004 | Fan | 482/57 |
| 6,837,838 | B2 * | 1/2005 | List | 482/147 |
| 6,852,070 | B1 * | 2/2005 | Herbert | 482/57 |
| 6,860,490 | B2 * | 3/2005 | Song | 280/7.1 |
| 7,303,510 | B2 * | 12/2007 | Gebhardt | 482/61 |
| 7,326,151 | B2 * | 2/2008 | Peterson et al. | 482/61 |
| 7,648,444 | B2 * | 1/2010 | Johnson | 482/52 |
| 7,935,027 | B2 * | 5/2011 | Graber | 482/51 |
| D641,798 | S * | 7/2011 | Latham | D21/419 |
| 2004/0053751 | A1 * | 3/2004 | Pizolato | 482/61 |
| 2004/0063549 | A1 * | 4/2004 | Kuo | 482/54 |

(Continued)

OTHER PUBLICATIONS http://www.trisports.com/kiroroprotr.html.
Lingel, Karen, "The Straight Dope: Why is it easier to balance on a moving bike than a non-moving one?", Jan. 29, 2002, http://www.straightdope.com/columns/read/1993/why-is-it-easier-to-balance-on-a-moving-bike-than-a-non-moving-one.
Bodycraft's Tour Trainer brochure.

*Primary Examiner* — Stephen Crow

(57) ABSTRACT

A portable stationary bicycle trainer comprises a main frame having a top end and a bottom end and having handlebars attached to the top end thereof. A support member having a first end and a second end is connected at its first end to the main frame. A plurality of pedals are rotatably engaged to the main frame at a position adjacent to the first end of the support member. An arcuately shaped base having varied topography that simulates outdoor variable-grade terrain is connected to the bottom end of the main frame and the second end of the support member. The portable stationary bicycle trainer simultaneously provides the user with leg exercise and core muscle strength training.

25 Claims, 10 Drawing Sheets

U.S. PATENT DOCUMENTS

2004/0198562 A1 10/2004 Greenleaf
2007/0049467 A1* 3/2007 Lin ..... 482/57
2007/0054782 A1* 3/2007 Lin ..... 482/57
2008/0026916 A1* 1/2008 Chuang et al. ..... 482/53

* cited by examiner

PORTABLE STATIONARY BICYCLE TRAINER

STATEMENT REGARDING FEDERALLY SPONSORED RESEARCH OR DEVELOPMENT

Not applicable.

BACKGROUND OF THE INVENTION

1. Field of the Invention

The present invention relates generally to an exercise stationary bicycle and, in particular, to a lightweight portable stationary bicycle trainer for simulating travel across outdoor variable-grade terrain while simultaneously providing the user with leg exercise and core muscle strength training.

2. Description of the Related Art

Core muscle strength training plays a crucial role and is essential in achieving maximum beneficial results during exercise. Core muscles comprise the muscles of the upper and front part of a user's body, including the obliques, abdominals, sides, and hip flexors.

Several different types of stationary bicycle trainer devices are currently available to allow users to simulate outdoor riding conditions. However, the majority of bicycle trainers are designed with a heavy base to provide a stable, adjustable, yet unmovable apparatus. Many are fully contained, highly adjustable units having a manually or computer modulated resistance device. Though effective for building strength in the legs, these units can be ridden without stimulating the muscles in the upper body or abdomen.

Spinner classes—indoor cycling classes where participants engage in a group workout on exercise bicycles—attempt to integrate movement into the routine by standing for periods and adjusting the resistance. But these do not address the changes one would see in lateral issues or incline issues and are unnatural in their body positions.

When one considers the dynamics of riding on mountain trails or the requirements of efficiency for road riders, bicycle trainers currently available limit the true benefits one can derive from a workout. Without core strength, riders are limited in their ability to right themselves from a fall or accurately position themselves to overcome an obstacle. Leg strength and cardiovascular gains may still be had with traditional trainers, but the less obvious core strength that a user gains outdoors is lost.

The present invention corrects the shortcomings of the currently available stationary bicycle trainer devices. In the present invention, a user's muscles (both her core and leg muscle groups) are worked more intensely than is done during the activity itself, e.g., bike riding, through the use of a lightweight base platform that is more dynamic than a bicycle. Coupled with variable resistance and/or the addition of weights, a total weight style workout is achieved through the simultaneous exercise of leg and core muscle groups.

A truly portable stationary bicycle should be lightweight and easy to transport from one location to another. The user should be able to use a portable stationary bicycle in the same space occupied by a conventional chair. Accordingly, there is a need for a lightweight, compact, easy to use, assemble and disassemble, and easy to transport portable stationary bicycle.

BRIEF SUMMARY OF THE INVENTION

The present invention provides a lightweight portable stationary bicycle that provides a complete cycling workout while additionally increasing balance and core muscle strength through the application of a small variable base design. The invention comprises a main frame having a top end and a bottom end and having handlebars attached to the top end thereof. A support member having a first end and a second end is connected at its first end to the main frame. The support member is at an angle of approximately sixty degrees relative to the main frame. A plurality of pedals is rotatably engaged to the main frame at a position adjacent to the first end of the support member. An arcuately shaped base is connected to the bottom end of the main frame and the second end of the support member. The bottom surface of the base contains varied topography that simulates outdoor variable-grade terrain.

The base determines the stability of the device. As such, different bases may provide varied levels of difficulty or workout emphasis for the user. The size and dimension of the base may vary. Additionally, air, gels, and water filled sacks, electromagnetic pins, and varied base topography profiles may be housed within the base or affixed to the base to add further variations in the feel and performance of the present invention. Bases may also be structured to provide varied stability breakpoints and data collection allowing users to determine efficiency and deficiency of body movement.

It is an object of the present invention to provide a fully contained portable stationary bicycle trainer that engages the upper body, legs and core muscles through variations in pitch, lateral dynamics, and variable resistance, including the addition of weight, that is light weight, compact and durable.

It is a further object of the present invention to provide a fully contained portable stationary bicycle trainer that simulates outdoor variable grade terrain.

As the user uses the bicycle trainer, she is engaging her leg muscles. Due to the nature of the present invention to rock forward and backwards, especially when the handlebars are freely rotatable, the user works her arms, from her forearms through to the lower shoulders. Consequently, the user not only gets leg muscle exercise (from pedaling), but also entire upper body exercise using the balancing nature of the present invention. This is especially so in the arms and abdomen resulting from having to maintain and regain balance which continually exercises those muscles. An advantage of the present invention is that the present invention provides much more flexibility for getting a full body workout than other types of bicycle training devices. It is the combination of pedaling and balancing that creates the optimum beneficial effects for the user during a workout.

The present invention requires the user to engage the muscles required for maintaining balance. This becomes critical in cycling, especially for trail riding and competitive racing as riders are pressing the limits of risk and performance. From the experiences of these cutting edge athletes, research on the role of core strength has also been shown to be essential for correct posture and total body strength.

Since the user is responsible for maintaining an upright position, all the mass and structure required by traditional trainers can be eliminated. The decreased structural requirements of a fully contained portable bicycle trainer allow for greater design variations enabling easier adaptability with resistance elements and other components. The frame can be designed structurally lighter since the only opposing forces are between hands and feet, not body to ground. This lighter frame system then enables the bicycle trainer to become truly portable capturing time and creating opportunities for working out at locations such as parks, sporting games and other venues where a user would generally sit or remain stationary as a spectator.

The present invention can be quickly and easily stored off to the side or out of sight, a valuable feature for home gym users, commercial gyms with limited floor space, and users who like to workout during the lunch hour in the office. The present invention may be manufactured out of any strong, rigid material, including alloys and steel, aluminum, hard plastic, fiberglass, and the like.

The design illustrated on the figures below is merely for illustrative purposes and not for limitation purposes. While the figures show use of nuts and bolts as fasteners, the present invention is intended to be used with knob and screw assemblies or other similar fasteners, such that no tools would be required during adjustment, assembly or disassembly, or interchanging of components.

DETAILED DESCRIPTION OF THE INVENTION

Figure 1:
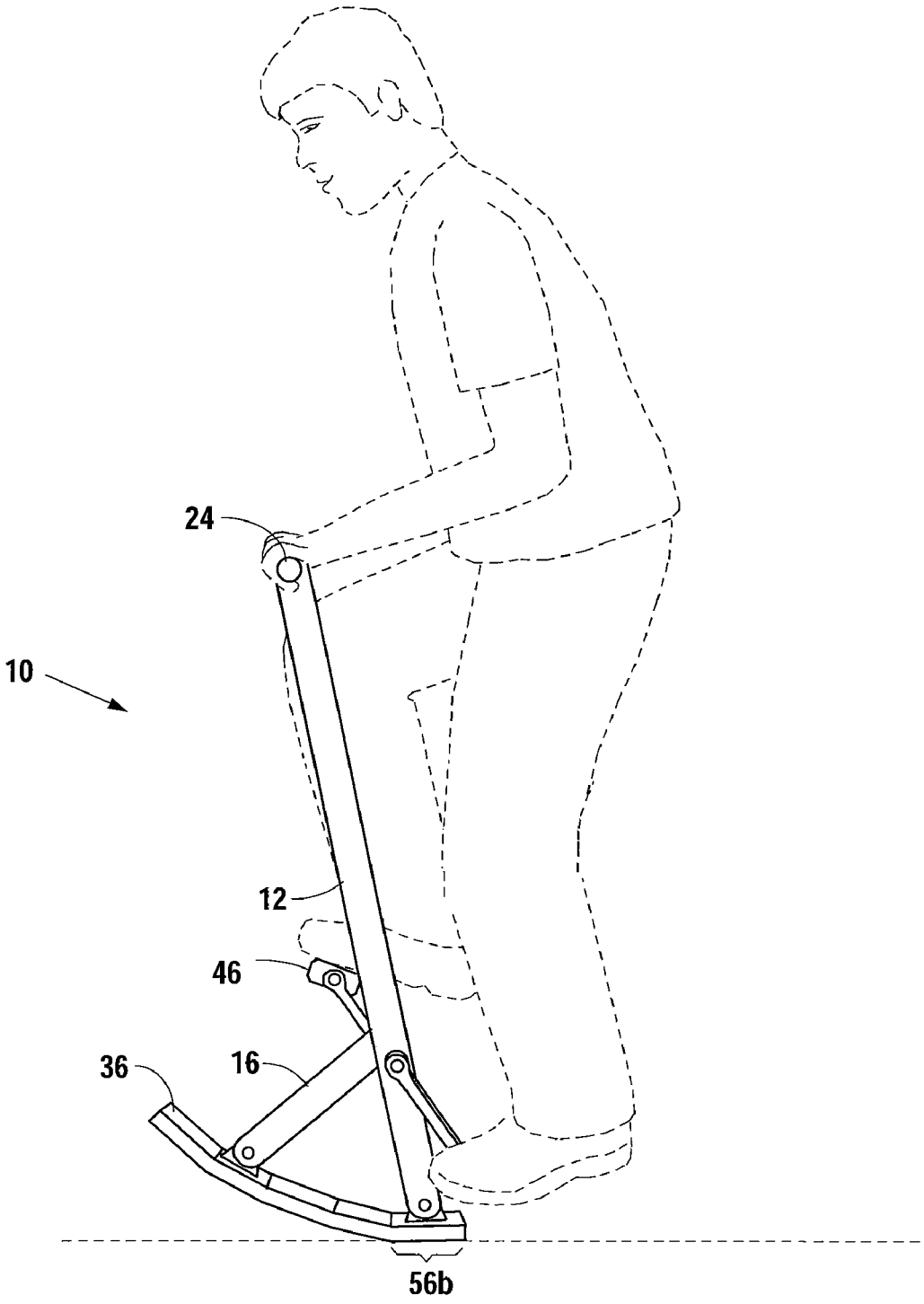
FIG. 1 shows a left side elevated view of the present invention in use by a user.

Referring to FIG. 1, a bicycle trainer 10 is comprised of a main frame 12 having a top end and a bottom end and having handlebars 24 attached at the top end thereof. A support member 16 having a first end and a second end is connected at its first end to main frame 12. A plurality of pedals 46 is rotatably engaged to main frame 12 at a position adjacent to the first end of support member 16. A base 36 is connected to the bottom end of main frame 12 and the second end of support member 16. Support member 16 is at an angle of approximately sixty degrees relative to main frame 12.

Figure 2:
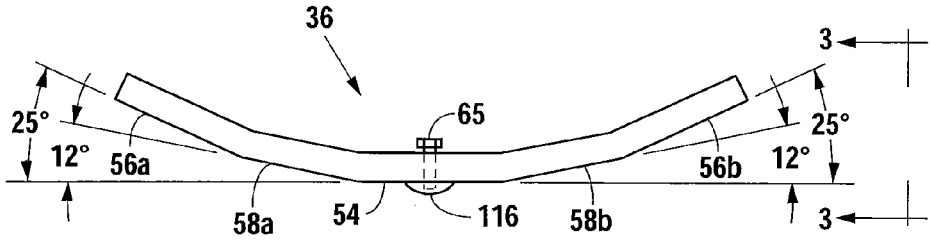
FIG. 2 depicts an elevated side view of the base of the present invention.

Referring now to FIG. 2, base 36 is comprised of a plurality of planes aligned in series and forming various angles relative to each other. Bottom plane 54 is the flattest plane relative to the ground surface and provides the least amount of inclination. Front middle plane 58*a* and back middle plane 58*b* provide an incline at a grade of at least twelve degrees relative to bottom plane 54. Front top plane 56*a* and back top plane 56*b* provide an incline at a grade of at least twenty-five degrees relative to bottom plane 54. Bottom plane 54 is the initial starting place for the workout and has what is called a "sweet spot." Each plane shares the characteristic of a "sweet spot." When not in use, bicycle trainer 10 will remain upright and at rest on one of these "sweet spots." Together, the net effect of the plurality of planes produces an arcuately shaped bottom surface of base 36.

The length of base 36 may range from about fourteen inches to about twenty-four inches. The width of base 36 typically ranges from about a half-inch inch to about six inches. The preferred length of base 36 in the preferred embodiment is about eighteen inches, with each plane preferably about between three and a half and six inches in length and base 36 containing four or five such planes.

Figure 3:
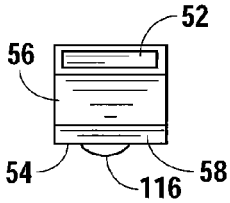
FIG. 3 shows an end view of FIG. 2 along section lines 3-3.
Figure 4:
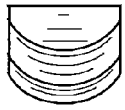
FIG. 4 shows an end view of FIG. 2 along section lines 3-3 of an alternative embodiment of the base portion of the present invention.
Figure 5:
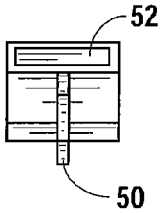
FIG. 5 shows an end view of FIG. 2 along section lines 3-3 of an alternative embodiment of the base portion of the present invention.

Base 36 in the present invention may be crafted to express varied topographies and thus, increase the difficulty of the user's workout. This may be accomplished by narrowing the planes or providing for additional planes such that the planes have even less surface area resulting in even smaller "sweet spots" (i.e., smaller areas on which to balance), and thus, provide for a more rigorous workout for the user. The addition of a screw 65 with concave end surface 116 further reduces the surface area on which the user may balance, further increasing the difficulty of the workout. Each plane included in the plurality of planes is independently interchangeable to provide for additional variable topography. The topography may be planar, curved, or planar with protrusions. Examples of varied topography for base 36 are illustrated in FIGS. 3, 4, and 5.

Figure 7:
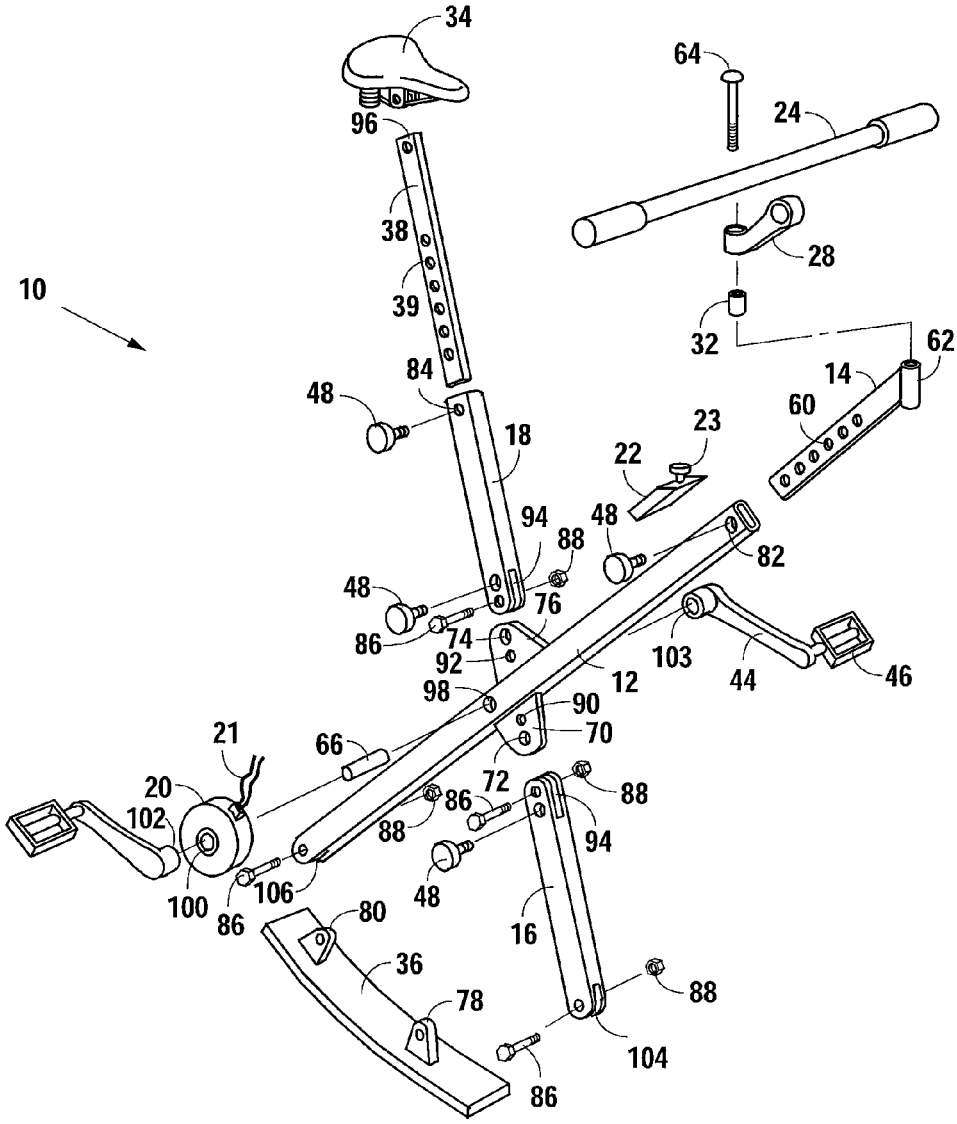
FIG. 7 shows an exploded perspective view of an alternative embodiment of the present invention.
Figure 8:
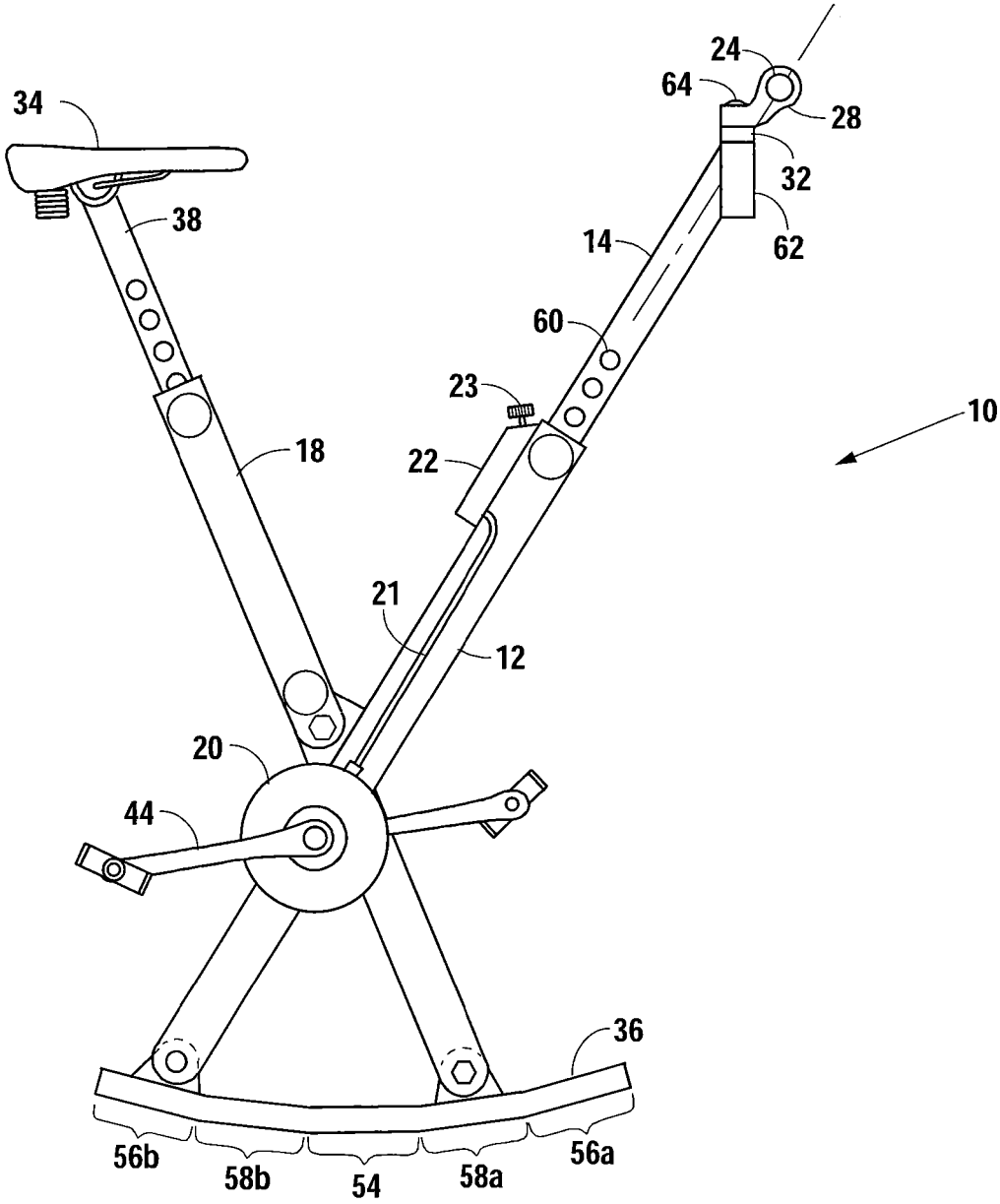
FIG. 8 shows a right side elevated view of an alternative embodiment of the present invention.
Figure 9:
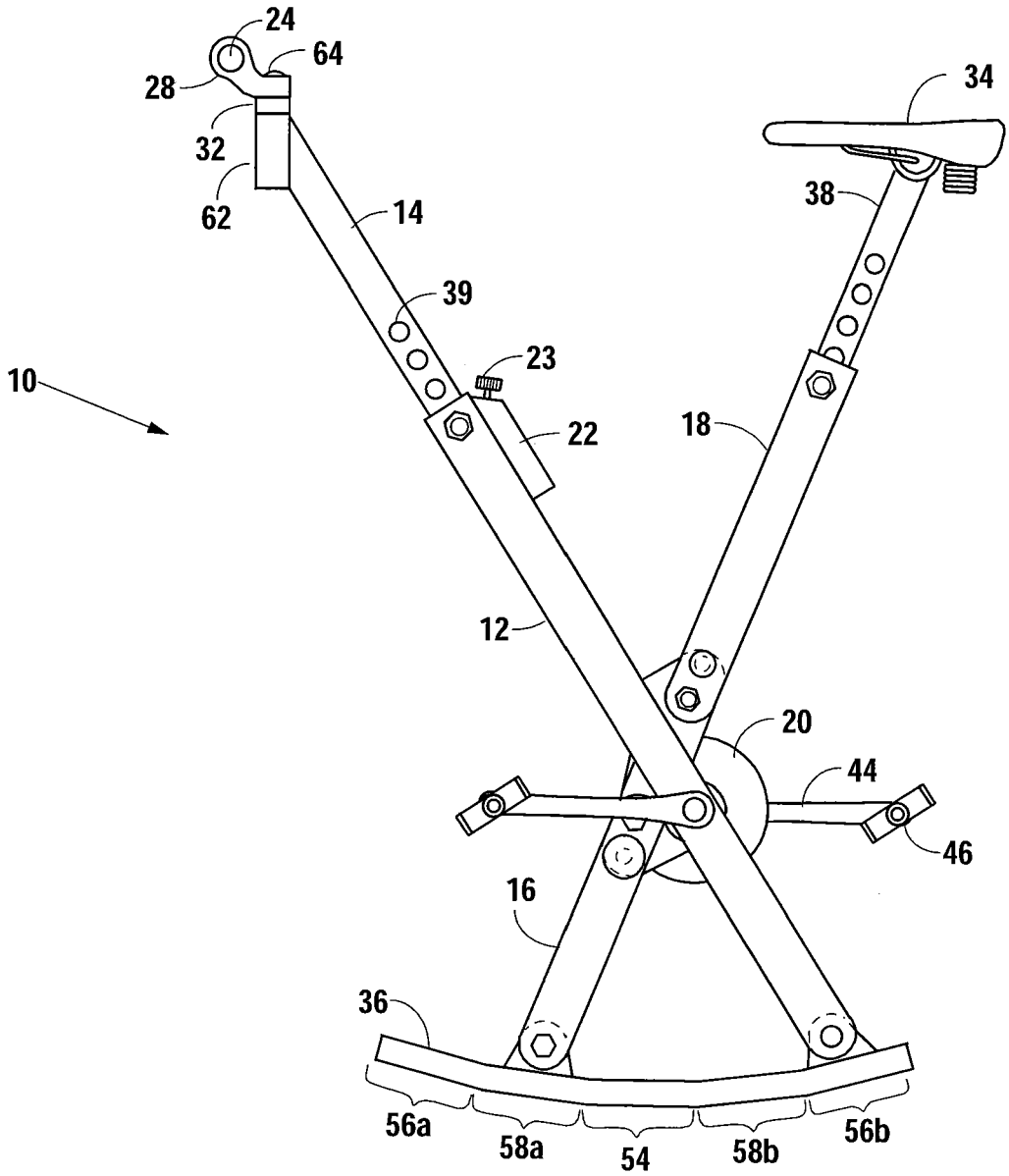
FIG. 9 shows a left side elevated view of an alternative embodiment of the present invention.
Figure 10:
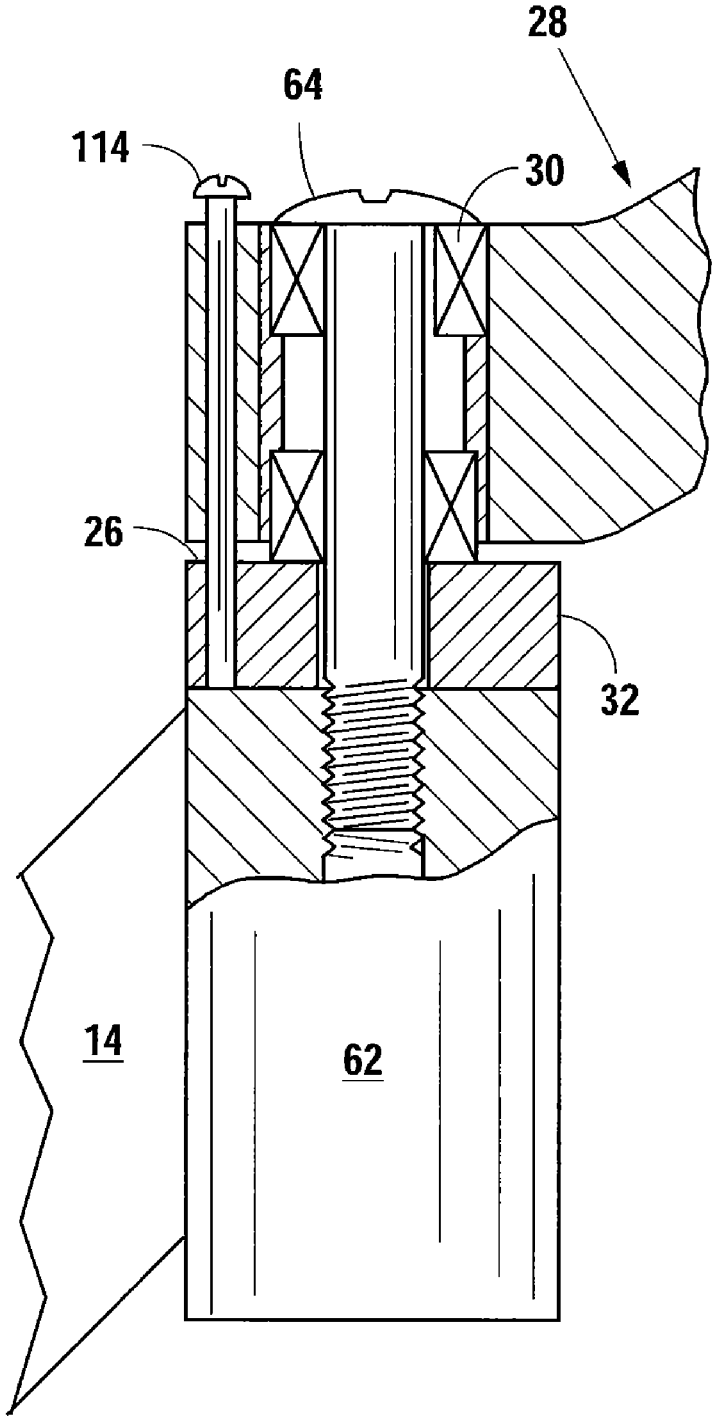
FIG. 10 is an elevated side view of the handlebar assembly of the present invention showing the handlebars in a fixed configuration.

In an alternative embodiment, and referring now to FIGS. 7, 8, and 9, handlebars 24 are removably attached to one end of main frame 12. Specifically, handlebars 24 are disposed within riser 28 such that riser 28 is substantially centered on handlebars 24. A bolt (not shown) within riser 28 is tightened to clamp around and securely fasten handlebars 24 in place. Bolt 64 fastens riser 28 to handle post end 62 by being threaded securely to threads within handle post end 62. Handlebars 24 are freely rotatable in a lateral direction relative to the ground simulating handlebar actions on a bicycle under actual riding conditions. A bearing 32 is disposed between riser 28 and handle post end 62. To fix handlebars 24 in a nonrotatable position, locking pin 114 traverses through riser 28 and bearing 32, as shown in FIG. 10. Locking pin 114 maintains handlebars 24 in a fixed position.

Handle post end 62 is fixedly attached to the top end of handle bar post 14. Main frame 12 contains main frame top apertures 82 at a portion proximate to handlebars 24. Main frame top apertures 82 are coaxially alignable with handle bar post apertures 60 of handle bar post 14. The position of handle bar post 14 relative to main frame 12 is adjustable and, until secured, may move freely within (i.e., telescopically) main frame 12 so that the height of handlebars 24 may be positioned according to the user's height. Knob 48 traverses main frame top apertures 82 and handle bar post apertures 60 to secure the desired position of handle bar post 14.

Main frame 12 contains lower tab 70 and upper tab 76 pivotally engaged to support member 16 and upper member 18, respectively. Top end of support member 16 and bottom end of upper member 18 contain recess 94 creating a fork configuration to accept lower tab 70 and upper tab 76, respectively. Lower tab 70 and upper tab 76 contain a plurality of apertures for pivotally connecting support member 16 and upper member 18 to main frame 12. Fastening devices such as nuts 88 and bolts 86 traverse small apertures 90 and 92 to secure support member 16 and upper member 18, respectively, to main frame 12. Knobs 48 traverse large apertures 72 and 74 to pivotally connect support member 16 and upper member 18, respectively, to main frame 12.

Removal of knobs 48 allow support member 16 and upper member 18 to pivot about bolt 86 of small apertures 90 and 92 such that support member 16 and upper member 18 may collapse toward and lie adjacent to main frame 12 to minimize storage space, as will be discussed in further detail below. Alternatively, the user may collapse only upper member 18 toward and adjacent to main frame 12, thereby removing seat 34 out of the user's way. Removing seat 34 forces the user to engage in her core muscles in order to maintain balance and, thus, provides for a more rigorous workout.

Still referring to FIGS. 7, 8, and 9, upper member top apertures 84 are coaxially alignable with seat post apertures 39 of seat post 38. Seat 34 is disposed at top end 96 of seat post 38. The position of seat post 38 relative to upper member 18 is adjustable and, until secured, may move freely within (i.e., telescopically) upper member 18 so that the height of seat 34 may be positioned according to the user's height. Ideally, this adjustment is coordinated with adjustment of the height of handlebars 24. Knob 48 traverses upper member top apertures 84 and seat post apertures 39 to secure the desired position of seat 34.

As shown in FIG. 7, pedals 46 are rotatably connected to cranks 44. Cranks 44 are rotatably connected to resistance mechanism 20, such as a weighted flywheel. Resistance mechanism 20 is alignable with bore 98 and positioned adjacent to main frame 12 such that axle 66 also traverses through opening 100 of resistance mechanism 20 and resistance mechanism 20 is interposed between inner end 102 of crank 44 and main frame 12. Inner ends 102 and 103 of cranks 44 are disposed on either end of axle 66.

Bottom end 104 of support member 16 is detachably and pivotally connected to front raised portion 78 of base 36 through the use of bolt 86 and nut 88. Similarly, bottom end 106 of main frame 12 is detachably and pivotally connected to back raised portion 80 of base 36, also through the use of bolt 86 and nut 88. Back raised portion 80 is positioned substantially toward the rear of base 36 (viewing the present invention from the perspective of the user on bicycle trainer 10) and coincides with back top plane 56*b*. Front raised portion 78 is positioned to coincide with front middle plane 58*a*.

Figure 13:
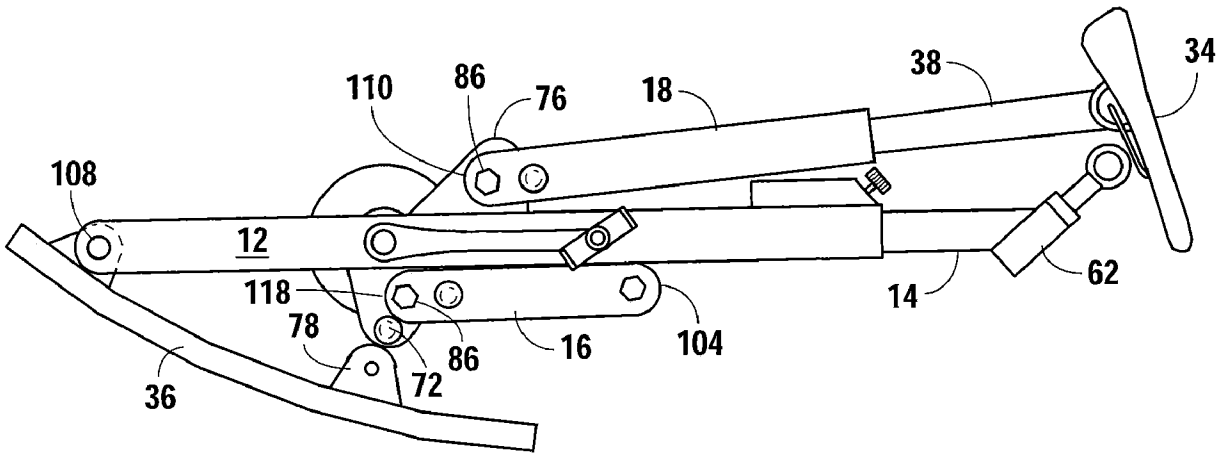
FIG. 13 depicts a collapsible view of FIG. 8.

An advantage of the present invention is the minimized use of space during storage and transportation. Referring to FIG. 13, the present invention is in a collapsible position ready for storage or transportation. To collapse the present invention for storage or transportation, bolt 86 is removed from bottom end 104 of support member 16. Knob 48 is removed from top end 118 of support member 16. Support member 16 then pivots about bolt 86 of small aperture 90 to lie substantially parallel against main frame 12. Base 36 then rotates about bolt 86 of aperture 108 such that front raised portion 78 is adjacent to lower tab 70 of main frame 12. Knob 48 is removed from bottom end 110 of upper member 18. Upper member 18 then rotates about bolt 86 of small aperture 92 such that upper member 18 is substantially parallel to main frame 12. To make for a more compact configuration, seat post 38 is inserted within upper member 18 and handle bar post 14 is inserted within main frame 12. Pedals 46 fold toward main frame 12 to further reduce storage space taken by the present invention.

Figure 12:
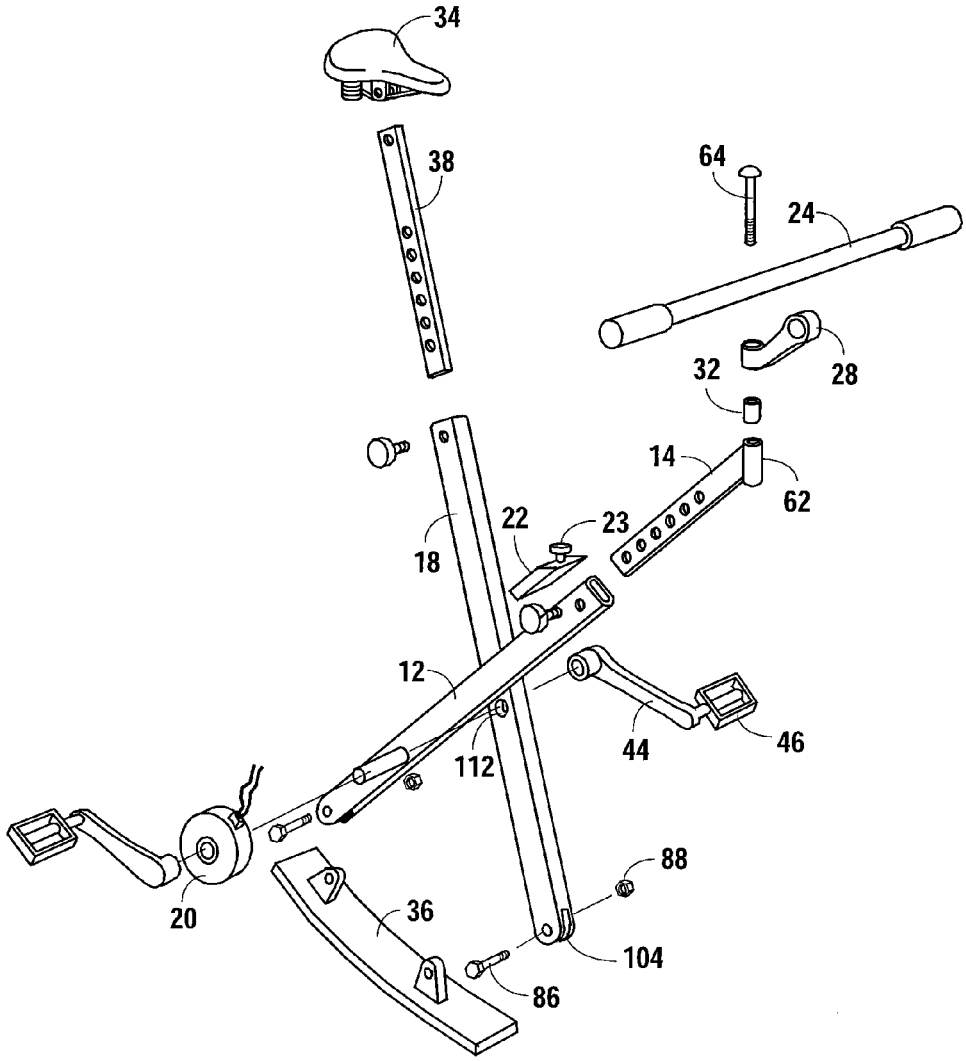
FIG. 12 depicts an exploded perspective view of an alternative embodiment of the present invention.
Figure 14:
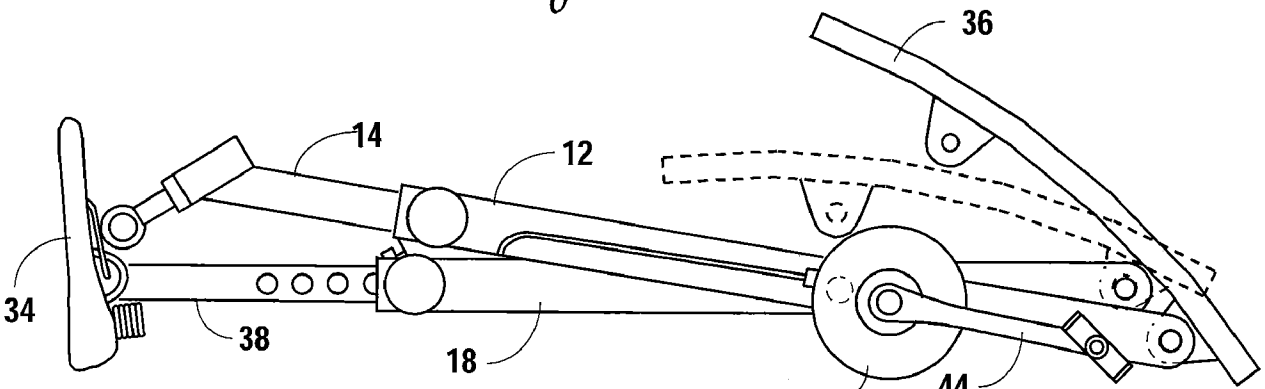
FIG. 14 depicts a collapsible view of FIG. 12.

Referring now to FIGS. 12 and 14, in another embodiment of the present invention a single center hinge point 112 pivotally connects upper member 18 and main frame 12. FIG. 14 shows this embodiment in a collapsed configuration. Bolt 86 is removed from bottom end 104 of support member 16. The present invention then collapses using a scissors action about center hinge point 112, bringing upper member 18 and main frame 12 together, and is ready for storage or transportation. Once in a collapsed configuration in either embodiment, bicycle trainer 10 can be easily transported in a carrying bag or the like.

Main frame 12, support member 16, upper member 18 and base 36 are preferably aluminum, but may be made from any strong, rigid material, including alloys and steel, plastic, fiberglass, and the like. While the present invention is described using knobs and nut-and-bolt assemblies, other fastening devices are contemplated to fall within the scope of the invention. For example, a locking pin, a ball lock pin, a compression clamp, or the like may also be utilized to secure the positions of handle bar post 14 and seat post 38. Additionally, it is intended that such fastening devices be quick release devices and that tools need not be required for adjustment, assembly or disassembly, or interchanging of components.

Figure 6:
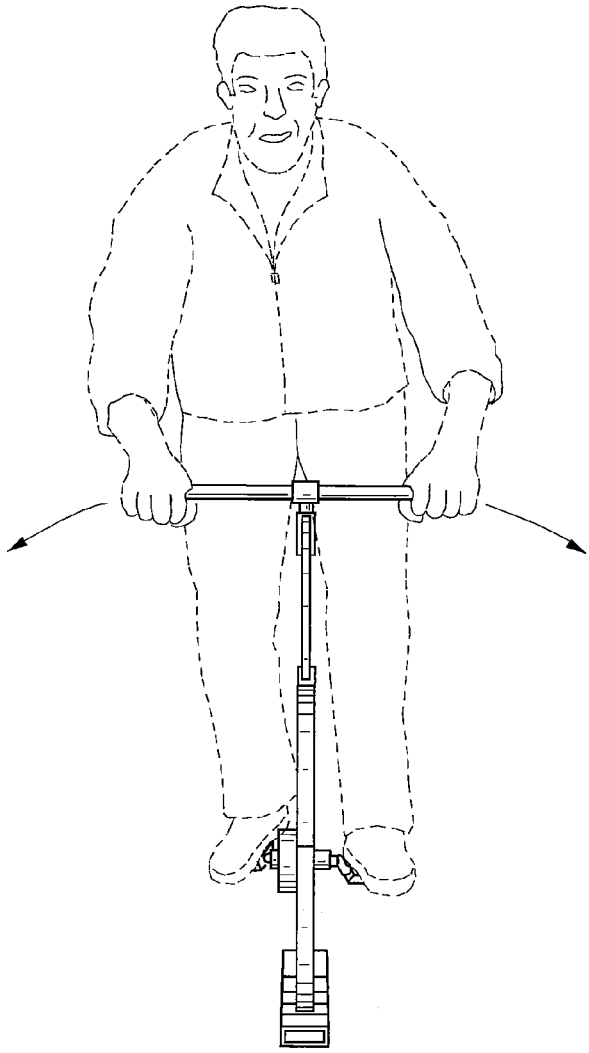
FIG. 6 shows a front view of the present invention in use by a user.
Figure 11:
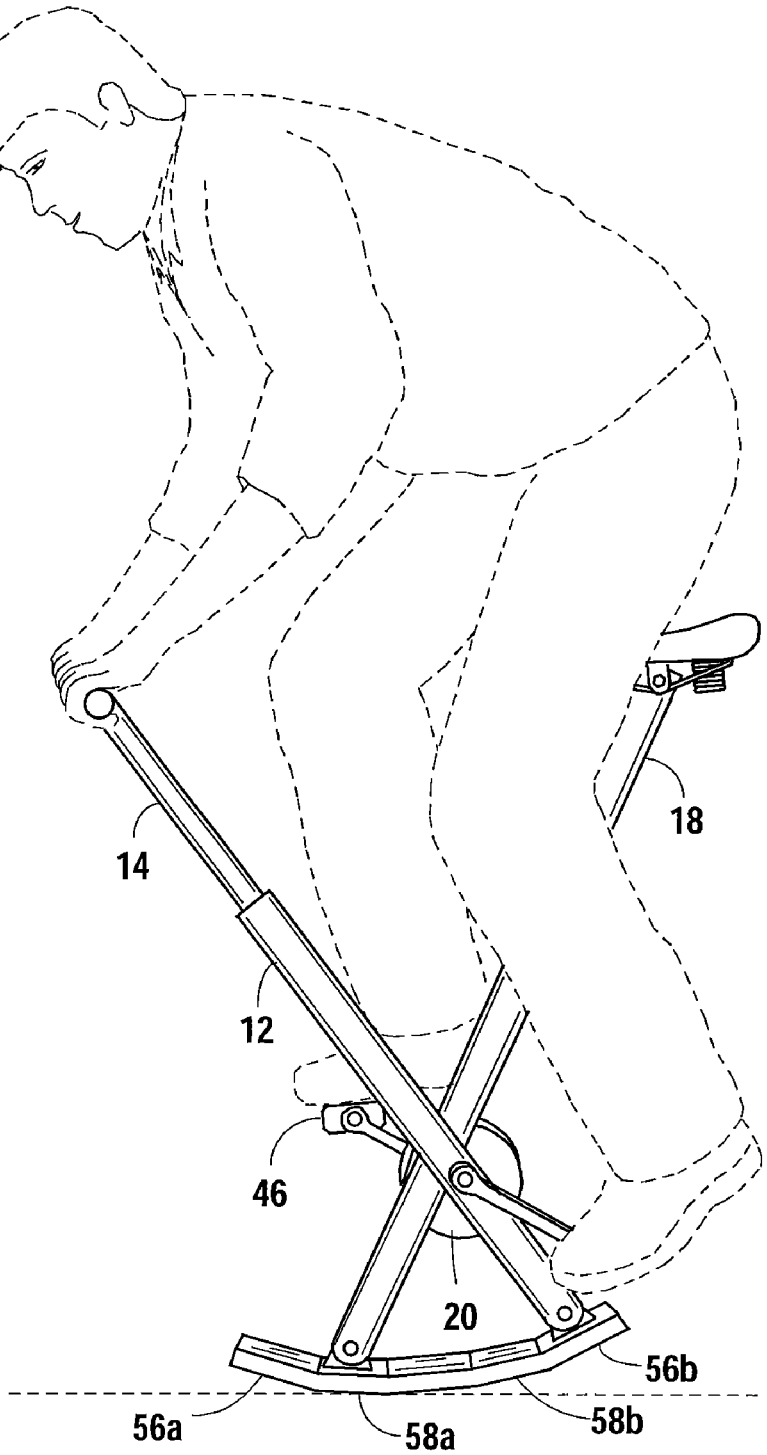
FIG. 11 shows a left side elevated view of an alternative embodiment of the present invention in use by a user.

Referring now to FIGS. 1, 6, and 11, in using the present invention, the user mounts the bicycle trainer 10 holding onto handlebars 24 and balancing her weight on pedals 46. Pedals 46 are freely rotatable, or free spinning, and without noticeable resistance, as shown in FIG. 1. The user is in an almost standing position pedaling in a forward direction. The user controls the speed and ease of pedaling during exercise while holding onto handlebars 24. As she pedals, the user must maintain her center of gravity over a "sweet spot" in order to keep her balance.

The dynamic configurations of base 36 increase the difficulty level for the user in maintaining her balance by increasing the likelihood that bicycle trainer 10 will lean quickly to one direction or another. The user may simulate travel across outdoor variable-grade terrain by varying the topography of the bottom surface of base 36, as previously discussed, thereby increasing the difficulty of the workout. The user is required to focus harder to control bicycle trainer 10, providing increased balance training and recovery skills.

When the user engages in exercise, the user will balance her weight so that bicycle trainer 10 is on at most a single plane at a time. Once the user has placed her full body weight on the bicycle trainer 10, the goal is for the user to balance the bicycle trainer 10 on the resting position, or "sweet spot." During the user's workout, the user is attempting to remain on the "sweet spots" as she simultaneously moves in various directions. The user will use her core muscles to regain balance and return to the "sweet spots" on each plane. The further away from the "sweet spots" the user gets—either any direction 360 degrees from the rest position—the harder she must work her core muscles to return back to the "sweet spot."

Alternatively, for the more advanced user, the user may attempt to balance bicycle trainer 10 on the points where two adjoining planes meet. Because of the reduced amount of surface area of the "sweet spot," balancing between planes proves to be a much more difficult task, and therefore, requires more strenuous use of one's core muscles. The result is a more rigorous workout.

Referring to FIG. 6, base 36 is dynamic resulting in side-to-side motion of bicycle trainer 10. The user experiences such side-to-side movement as well as front to back and generally movement in all directions which may force the user off balance. The user uses her core muscles to overcome these opposing forces in order to maintain balance of the bicycle trainer 10 on the "sweet spot," and, thus, achieve her goal.

FIG. 11 shows a left side elevated view of the present invention in use by a user. Upper member 18 is at an angle of about sixty degrees relative to main frame 12. The user must continuously compensate for and adjust her body weight against the continuous forces attempting to put the user off balance. For example, as bicycle trainer 10 tilts forward onto a different plane, e.g., front middle plane 58*a*, the user must compensate by pulling back on handlebars 24. Similarly, as bicycle trainer 10 tilts backwards onto, for example, back top plane 56*b*, the user must push forward against handlebars 24 to maintain balance. When bicycle trainer 10 tilts laterally to either one side or another, the user must shift her weight to the opposite side of the tilt to maintain balance and avoid falling down, as shown in FIG. 6.

The user continues her pedaling action, thereby exercising her legs, as she negotiates these forces. Further, in making these compensating movements, the user simultaneously and necessarily uses her core muscles to aid in maintaining her balance to keep from falling.

When a user rides a bicycle outdoors and comes to a hill, especially a steep hill, the user generally tends to stand when riding uphill. The bicycle tends to move from side-to-side as the user pedals and negotiates the hill. Similarly, in the present invention, the user is in a standing position on bicycle trainer 10 simulating climbing a hill. In this fashion, the user is allowed the freedom to move bicycle trainer 10 as she would if she were actually riding up a hill outdoors, including pedaling and moving bicycle trainer 10 side-to-side.

Referring to FIG. 1, a mountain climb simulation of up to 25° is possible. The user may simulate this incline by simultaneously leaning forward and pulling handlebars 24 toward her and rotating bicycle trainer 10 back toward the back portion of base 36 such that the user is balancing on back top plane 56*b* and she continues to pedal, as shown in FIG. 1. Similarly, the user may adjust the incline by rotating bicycle trainer 10 onto other planes. In rotating bicycle trainer 10 onto the various planes and topographies of base 36, the user appreciates the natural position of handlebars 24 and the true feeling of riding up a hill as she sways from side-to-side on bicycle trainer 10.

In the present invention, the user's body weight is the workload that she negotiates while using bicycle trainer 10. The user must pedal and simultaneously balance her body weight to avoid falling over. With each rotation of pedals 46 (and while in different positions in a rotation of pedals 46) different forces act upon the user tending to make her lean in various directions. The user uses her core muscles to compensate and overcome these forces to maintain her balance.

The user may increase her workload during her exercise by adding weight onto handlebars 24. The weight can be in the form of a weight plate or plates that would slide onto handlebars 42 and held against main frame 12 through the use of a spring clamp. As the user rocks back and forth, the added weight will increase the gravitational force tending to pull bicycle trainer 10 in a forward direction. To keep from falling forward, the user must now overcome this increased forward tending gravitational force with a greater force in the opposite direction to maintain balance.

In an alternative embodiment of the present invention, the user may increase her workout by the addition of resistance mechanism 20 that produces various degrees of friction against the user's pedaling action. The user may vary the resistance used through the use of a controller either mechanically or electrically to increase the friction produced to simulate riding up an incline or to decrease the friction produced to simulate riding down an incline. As shown in FIGS. 7, 8, 9, and 11, resistance mechanism 20 may be in the form of a friction-type of application using either a disc, wheel or drum system. However, other resistance mechanisms, such as magnetic, hydraulic, electromagnetic, wind, weight and the like are also acceptable.

Referring to FIG. 8, controller 22 electrically connects with cables 21 to resistance mechanism 20. The user may manipulate controller 22 to select the desired difficulty of exercise the user wishes to engage. The user may adjust the resistance according to a predefined program through the use of controller knob 23. The user may also define and set parameters in a custom program that the user may then select using controller knob 23. A graphical readout (not shown) allows the user to monitor her activities and progress (e.g., heart rate, mileage, time, speed, incline grade) during the course of a workout.

Balance is the key to an effective workout session. The user may simulate outside riding conditions by programming controller 22 to sporadically send a discharge to resistance mechanism 20 simulating hitting a rock, which throws off the user's balance. The sporadic discharge, or pulse, creates an opportunity for the user to recover her balance. The user is forced then to spontaneously engage in her core muscles to regain balance. This disruptive pulse would abruptly cause the user to either go forward, backwards, or to the side forcing the user to engage her core muscles to regain her balance. Such simulated disruptive riding environment conditions provide increased balance training and recovery skills.

Figure 15:
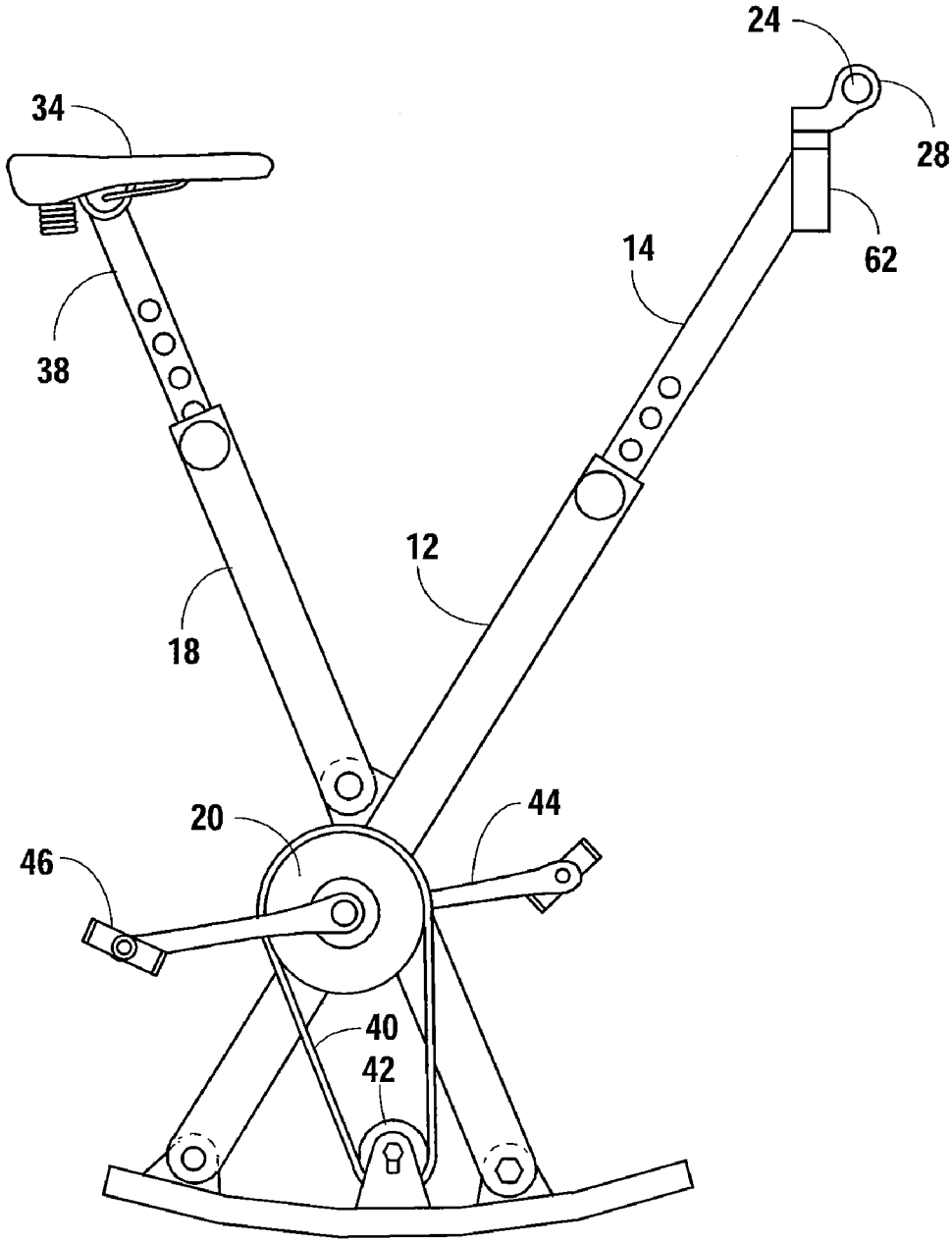
FIG. 15 shows a right side elevated view of an alternative embodiment of the present invention.

FIG. 15 illustrates another alternative embodiment of the present invention. Belt 40 operably connects resistance mechanism 20 to pulley 42. As user pedals, belt 40 causes pulley 42 to rotate. Pulley 42 may provide additional resistance. The user controls the difficulty of such resistance either manually—by adjusting the tension of a cable, e.g., shifting a lever and tightening the tension on a cable—or electronically using a computer. In another aspect of the present invention, pulley 42 may be enclosed in a housing or gear box (not shown) which in turn is operably connected with a cable to an external resistance source, such as a fan or rotational weight stack (not shown). Using an external resistance source with pulley 42 allows the user with the ability to maneuver bicycle trainer 10 quickly while maintaining a sturdy fixed weight resistance connection through the use of a cable-driven attachment (not shown).

The present invention is described above in terms of a preferred illustrative embodiment of a specifically described portable lightweight stationary bicycle trainer, as well as alternative embodiments of the present invention. Those skilled in the art will recognize that alternative constructions and implementations of such an apparatus can be used in carrying out the present invention. Other aspects, features, and advantages of the present invention may be obtained from a study of this disclosure and the drawings, along with the appended claims.

I claim:

1. A portable stationary bicycle trainer comprising:

a single main frame having a top and bottom end;

handlebars attached at said top end of said main frame;

a support member having a first end and a second end, said first end connected to said main frame;

a plurality of pedals rotatably engaged to said main frame near said bottom end; and a single base having an arcuately shaped bottom surface, said base connected to said bottom end of said main frame and said second end of said support member wherein a user rotates said pedals while in an upright position.

2. The portable stationary bicycle trainer of claim 1 wherein said bottom surface of said base further comprising a plurality of planes aligned in series.

3. The portable stationary bicycle trainer of claim 2 wherein at least one plane of said plurality of planes is at an angle of between 0° and 13° relative to the ground surface.

4. The portable stationary bicycle trainer of claim 2 wherein at least one plane of said plurality of planes is at an angle of between 0° and 26° relative to the ground surface.

5. The portable stationary bicycle trainer of claim 1 wherein said bottom surface of said base is curved.

6. The portable stationary bicycle trainer of claim 1 wherein said bottom surface of said base further comprising a protrusion.

7. The portable stationary bicycle trainer of claim 1 wherein said base is detachably connected to said bottom end of said main frame and said second end of said support member.

8. The portable stationary bicycle trainer of claim 1 further comprising a seat post having one end connected to said main frame and a seat connected to a second end of said seat post, said seat post having an angle of approximately sixty degrees relative to said main frame.

9. The portable stationary bicycle trainer of claim 8 wherein said seat post further comprising an outer member having one end pivotally connected to said main frame, an inner member having one end telescopically engaged to a second end of said outer member and said seat connected to a second end of said inner member.

10. The portable stationary bicycle trainer of claim 9 wherein said trainer is collapsible.

11. The portable stationary bicycle trainer of claim 1 wherein said handlebars are freely rotatable in a lateral direction relative to the ground surface.

12. The portable stationary bicycle trainer of claim 11 wherein said handlebars are removably attached at said top end of said main frame.

13. The portable stationary bicycle trainer of claim 1 further comprising a resistance mechanism for increasing or decreasing resistance of said plurality of pedals.

14. The portable stationary bicycle trainer of claim 13 wherein said resistance mechanism is a weighted flywheel that increases or decreases the amount of friction produced by said plurality of pedals.

15. The portable stationary bicycle trainer of claim 13 wherein resistance mechanism is a disc.

16. The portable stationary bicycle trainer of claim 13 wherein resistance mechanism is a drum.

17. The portable stationary bicycle trainer of claim 13 wherein said resistance mechanism operates hydraulically.

18. The portable stationary bicycle trainer of claim 13 wherein said resistance mechanism operates electromagnetically.

19. The portable stationary bicycle trainer of claim 13 wherein said resistance mechanism operates by wind.

20. The portable stationary bicycle trainer of claim 13 further comprising a controller for controlling said resistance mechanism using a predefined program.

21. The portable stationary bicycle trainer of claim 13 further comprising a pulley operably connected to an external resistance source.

22. The portable stationary bicycle trainer of claim 21 wherein said external resistance source is a fan.

23. The portable stationary bicycle trainer of claim 21 wherein said external resistance source is a rotational weight stack.

24. A method of exercise using a portable stationary bicycle trainer comprising the following steps of:

moving a portable stationary bicycle trainer to a desired location for use during an exercise period, said portable stationary bicycle trainer comprising:

a single main frame having a top and bottom end;

handlebars attached at said top end of said main frame;

a support member having a first end and a second end, said first end connected to said main frame;

a plurality of pedals rotatably engaged to said main frame near said bottom end; and a single base having an arcuately shaped bottom surface, said base connected to said bottom end of said main frame and said second end of said support member;

mounting said portable stationary bicycle trainer;

grasping said handlebars of said portable stationary bicycle trainer;

stepping on at least one pedal of said portable stationary bicycle trainer;

placing full body weight on said portable stationary bicycle trainer;

pedaling said at least one pedal while simultaneously balancing said full body weight on said portable stationary bicycle trainer; and dismounting said portable stationary bicycle trainer after said exercise period is complete.

25. The method of exercise as recited in claim 24 further comprising the step of:

placing a preselected amount of weight on said handlebars, said weights secured to said handlebars using a spring clamp.

* * * * *